US008127518B2

(12) United States Patent
Ford

(10) Patent No.: US 8,127,518 B2
(45) Date of Patent: Mar. 6, 2012

(54) FLAT BLANK CARTON

(75) Inventor: Colin Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 190 days.

(21) Appl. No.: 12/623,720

(22) Filed: Nov. 23, 2009

(65) Prior Publication Data

US 2010/0064636 A1 Mar. 18, 2010

Related U.S. Application Data

(62) Division of application No. 11/359,277, filed on Feb. 22, 2006, now abandoned.

(51) Int. Cl.
*B65B 5/02* (2006.01)

(52) U.S. Cl. ..... 53/458; 53/564; 53/376.7; 53/377.2; 53/378.3

(58) Field of Classification Search ..... 53/456, 53/457, 458, 564, 250, 376.7, 377.2, 377.8, 53/378.3

See application file for complete search history.

(56) References Cited

U.S. PATENT DOCUMENTS

| | | | | |
|---|---|---|---|---|
| 2,337,198 | A | 12/1943 | Holy | |
| 2,785,845 | A | 3/1957 | Stenger | |
| 2,894,674 | A | 7/1959 | Wagaman | |
| 3,165,253 | A * | 1/1965 | Adams et al. | 229/150 |
| 3,184,136 | A | 5/1965 | Forbes | |
| 3,442,063 | A | 5/1969 | Martin | |
| 3,596,798 | A | 8/1971 | Smith | |
| 3,673,763 | A | 7/1972 | Dorfmann | |
| 3,716,962 | A | 2/1973 | Langen et al. | |
| 3,782,071 | A | 1/1974 | Hagedorn | |
| 3,829,004 | A | 8/1974 | Graser | |
| 3,893,380 | A | 7/1975 | Wallin et al. | |
| 3,949,931 | A | 4/1976 | Hall | |
| 3,952,635 | A | 4/1976 | Mims | |
| 4,213,285 | A | 7/1980 | Mancini | |
| 4,308,712 | A | 1/1982 | Hagedorn | |
| 4,405,304 | A | 9/1983 | Bensberg et al. | |
| 4,499,704 | A | 2/1985 | Bacon et al. | |
| 4,554,777 | A | 11/1985 | Denk et al. | |
| 4,565,048 | A | 1/1986 | Lade | |

(Continued)

FOREIGN PATENT DOCUMENTS

DE 28 05 596 8/1979

(Continued)

OTHER PUBLICATIONS

Office Action mailed Mar. 3, 2010, from related Chinese Application No. 200780010359.5 (with translation).

(Continued)

*Primary Examiner* — Hemant M Desai
(74) *Attorney, Agent, or Firm* — Womble Carlyle Sandridge & Rice, LLP

(57) ABSTRACT

A flat blank carton is provided for packaging articles or products. The flat blank carton includes a base, a top, and a rear panel, hingedly connected to one another, and pairs of upper and lower side flaps hingedly attached to the top and base panels, respectively. The upper and lower side flaps include locking projections and corresponding locking recesses that are brought into mating, locking engagement as the top panel is folded over the base panel. After loading with products, the front end flaps of the cartons can be sealed to close the cartons.

23 Claims, 6 Drawing Sheets

U.S. PATENT DOCUMENTS

| | | | | |
|---|---|---|---|---|
| 4,604,083 | A | 8/1986 | Barny et al. | |
| 4,619,637 | A | 10/1986 | Jones | |
| 4,804,352 | A | 2/1989 | Schmidt | |
| 5,022,582 | A | 6/1991 | Ritter | |
| 5,049,119 | A | 9/1991 | Bershadsky | |
| 5,106,359 | A | 4/1992 | Lott | |
| 5,175,976 | A * | 1/1993 | Petry et al. | 53/252 |
| 5,186,706 | A | 2/1993 | Hartness et al. | |
| 5,337,951 | A | 8/1994 | Roccaforte | |
| 5,369,938 | A * | 12/1994 | Panveno et al. | 53/456 |
| 5,484,377 | A | 1/1996 | Ueda et al. | |
| 5,657,610 | A * | 8/1997 | Dietrich et al. | 53/139.5 |
| 5,980,440 | A | 11/1999 | Mitman et al. | |
| 6,223,978 | B1 * | 5/2001 | Drager | 229/109 |
| 6,571,539 | B2 * | 6/2003 | Gendre et al. | 53/456 |
| 6,827,678 | B1 | 12/2004 | Kümpel | |
| 6,886,311 | B2 | 5/2005 | Toth et al. | |
| 2001/0037626 | A1 * | 11/2001 | Kouyoumdjian | 53/452 |
| 2003/0150903 | A1 * | 8/2003 | Hanna | 229/149 |
| 2003/0163978 | A1 * | 9/2003 | Correll | 53/452 |
| 2004/0031236 | A1 | 2/2004 | Boix | |
| 2005/0274779 | A1 * | 12/2005 | Kuhn et al. | 229/143 |

FOREIGN PATENT DOCUMENTS

| | | | |
|---|---|---|---|
| EP | 0 680 882 | | 11/1995 |
| EP | 1 428 759 | | 6/2004 |
| GB | 940991 | A | 11/1963 |
| GB | 994247 | A | 6/1965 |
| GB | 1171775 | A | 11/1969 |
| JP | 47-042081 | | 12/1972 |
| JP | 54-109729 | | 8/1979 |
| JP | 06-007467 | | 1/1994 |
| JP | 11-278463 | | 10/1999 |
| JP | 2000-335561 | | 12/2000 |
| JP | 2002-240807 | | 8/2002 |
| JP | 2003-291946 | | 10/2003 |
| WO | WO 02/14165 | A1 | 2/2002 |

OTHER PUBLICATIONS

Office Action for JP 2008-556312.

International Search Report and Written Opinion—PCT/US2007/000275.

Office Action mailed Jan. 5, 2009, from related U.S. Appl. No. 11/359,277.

Response to Restriction Requirement dated Jan. 27, 2009, from related U.S. Appl. No. 11/359,277.

Office Action mailed Feb. 13, 2009, from related U.S. Appl. No. 11/359,277.

Amendment A and Response to Office Action dated May 7, 2009, from related U.S. Appl. No. 11/359,277.

Office Action mailed Aug. 31, 2009, from related U.S. Appl. No. 11/359,277.

* cited by examiner

FLAT BLANK CARTON

CROSS-REFERENCE TO RELATED APPLICATION

This application is a divisional of application Ser. No. 11/359,277, filed Feb. 22, 2006.

INCORPORATION BY REFERENCE

The entire disclosure of U.S. patent application Ser. No. 11/359,277, filed Feb. 22, 2006 is incorporated herein in their entirety by this reference.

FIELD OF THE INVENTION

The present invention generally relates to cartons and other articles for packaging products, and in particular, to a flat blank carton having integrally formed mechanisms to enable locking together of the sides of the carton.

BACKGROUND OF THE INVENTION

In the packaging of products such as bottles, cans, pouches or other similar articles, it is common for such products to be packaged in paperboard cartons, such as to form twelve packs, twenty-four packs, or other similar package configurations. Such cartons can be fed into a packaging machine and wrapped about the products or articles being packaged, with the lower or bottom edges of the cartons folded under and either glued or locked together by the engagement of locking tabs with locking recesses formed therein. Alternatively, in the packaging of larger groups of products, such as twelve packs of cans or bottles, or for packaging other larger and/or irregularly shaped articles, such as frozen pizzas, juice pouches, etc., the cartons typically are formed into pre-glued sleeves having open ends. These pre-glued sleeves generally are pulled from a stack or supply, opened, and fed into a packaging machine. The products then will be inserted, typically through one end of the sleeve, and the sleeve ends folded and glued shut.

One drawback of utilizing cartons into the pre-glued sleeves for product packaging applications, however, is that such pre-formed sleeves typically are more expensive to produce than conventional stamped or die cut wrapped carton sheets. After stamping or cutting, the carton blanks must be folded and their side edges glued together to form the carton sleeves, which accordingly results in increased costs from a materials and manufacturing standpoint, due to the additional glue required to form the sleeves, and in the need for additional folding and gluing equipment. Further, since the carton sleeves are formed by the folding over of the carton blank material, the carton sleeves generally are thicker than single sheet die cut blanks, and also need to be shipped in cases. As a result, shipping such carton sleeves in cases typically takes up a significantly greater amount of space when stacked on pallets for transportation and storage. This can require additional material handling to arrange and stack the cartons in cases, which, with the cost of the case, further increases the costs of manufacture thereof. A flat blank carton can be stacked directly on the pallet eliminating the need for gluing or cases.

Accordingly, it can be seen that a need exists for a carton design adapted for packaging various types of products that addresses the foregoing and other related and unrelated problems in the art.

SUMMARY OF THE INVENTION

Briefly described, the present invention generally is directed to a flat blank carton that can be used for packaging a variety of different types and configurations of articles or products. The carton can be transported in a flat blank, or sheet as stamped configuration and formed into a carton for receiving the articles to be packaged therein as the carton blank is moved along a product packaging line. The flat blank carton of the present invention generally will include a base panel, a top panel, and a rear panel extending between the base and top panels, with the base and top panels being connected to the rear panel by first and second laterally extending fold lines. Each of the top and base panels further includes front side edges along which upper and lower front flaps are hingedly connected along third and fourth laterally extending fold lines, respectively. A pair of opposed first and second, or upper side flaps are hingedly connected to the top panel along first and second longitudinal fold lines, while a pair of opposed lower or third and fourth side flaps are hingedly connected to the based panel along third and fourth longitudinally extending fold lines. End flaps further can be hingedly connected to the ends of the upper and/or lower side flaps adjacent the upper and/or lower front flaps, respectively.

Locking mechanisms will be formed in each of the upper and lower side flaps. The locking mechanisms can include a variety of designs or features, such as, for example, including one or more locking tabs or projections formed in each of the upper side flaps. Each such locking projection will be received within a corresponding locking recess or opening formed in the lower side flaps so as to engage and create a mating engagement between the side flaps of the flat blank carton when the top panel has been folded over and is substantially extending parallel to the base panel. The locking projections can be formed in various configurations, and alternatively can be provided along the lower side flaps, with the upper side flaps including opposed, mating, locking recesses or openings. The locking openings further can be formed in various configurations, including cut-outs of a substantially triangular or rectangular design, or can be formed as substantially T-shaped, L-shaped, or cross-shaped slits or cuts through which the locking projections will pass.

Additionally, gussets are formed between the upper and lower side flaps adjacent the rear panel. The gussets can be formed from cutout or cut-away portions, or can be formed by cutting, scoring, creasing, or otherwise forming fold lines therethrough. As a result, when the top panel is folded over toward the lower or base panel, the gussets tend to fold and/or be urged inwardly to enclose and seal about the corners between the top, rear, and base panels and the upper and lower side flaps as the upper and lower side flaps are brought into locking engagement, so as to enclose and seal the rear end of the carton.

Typically, during use on a packaging line, the flat blank cartons of the present invention will be received between lugs or within a jig mounted on a carton conveyor, which conveys the carton blanks along a path of travel for the packaging line or packaging machine. As the carton blanks are placed between the lugs of the carton conveyor, their side and end flaps typically will be folded upwardly into a substantially parallel, vertically upstanding attitude. As the carton blanks are conveyed along their path of travel, the top panel of each carton typically will be engaged by a plow or similar turning mechanism that guides the top panel upwardly across the base panel, causing the top and rear panels to be folded along the first and second lateral fold lines. At the same time, the gusset portions can be engaged and urged to fold inwardly toward the side flaps and rear panel. As the top panel is folded over the base panel, the upper side flaps are guided inwardly, typically by the lugs of the carton conveyor, toward the upstanding lower side flaps.

As the upper side flaps pass by the lower side flaps, the locking projections formed in the upper side flaps generally are engaged by one or more locking lugs mounted within the lugs or jig of the carton conveyor, which lugs generally each include a tongue or projection that is biased inwardly so as to urge and direct the locking projections inwardly. As the locking projections are pressed inwardly against the portions of the lower side flaps in which the corresponding locking recesses are formed, the locking projections or tabs will tend to become urged into their corresponding locking recesses so as to engage the lower side flaps to lock the upper and lower side flaps together.

Thereafter, articles or products to be packaged, such as frozen pizzas, cans, etc., can be inserted into the open front ends of the cartons. The front and end flaps of the cartons then can be glued and folded together so as to seal the carton, which then can be conveyed away from the product-packaging line for storage and transport.

Various objections, features and advantages of the present invention will become apparent to those skilled in the art upon review of the following detailed description when taken in conjunction with the accompanying drawings.

DETAILED DESCRIPTION OF THE INVENTION

Referring now in greater detail to the drawings in which like numerals indicate like parts throughout the several views, FIGS. 1-4 generally illustrate the flat blank carton 10 of the present invention and the folding and locking operations thereof. The flat blank carton 10 of the present invention can be utilized in packaging a wide variety of different sizes and shapes of articles or products such as cans, bottles, pouches, frozen pizzas and other, similar products, as well as a wide variety of other configuration or sizes of products. It further will be understood that the flat blank carton 10 of the present invention can be formed in substantially standard sizes for various packaging applications.

Figure 1:
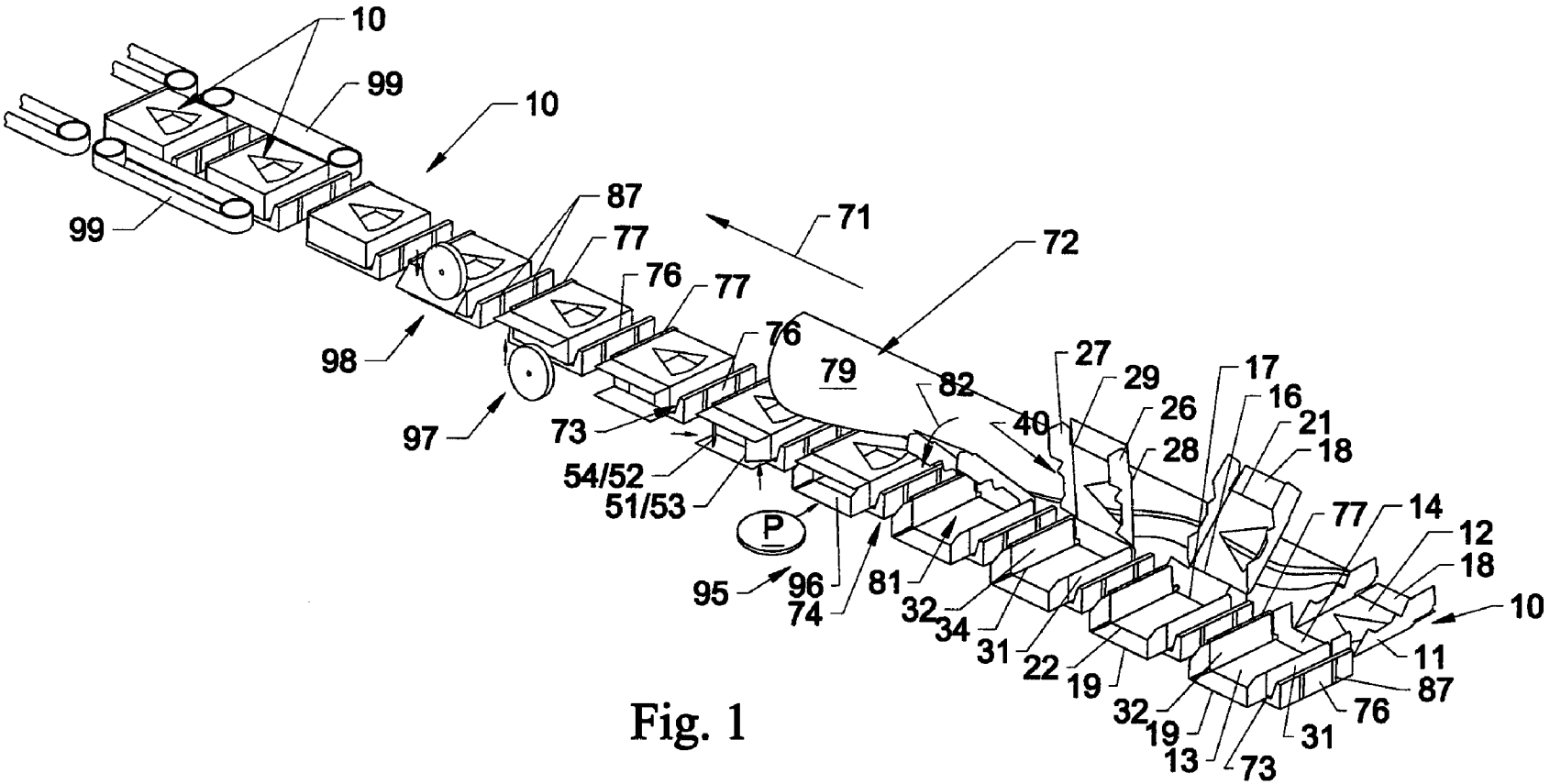
FIG. 1 is a perspective view, schematically illustrating the process by which the flat blank cartons of the present invention can be formed and loaded with products.
Figure 2A:
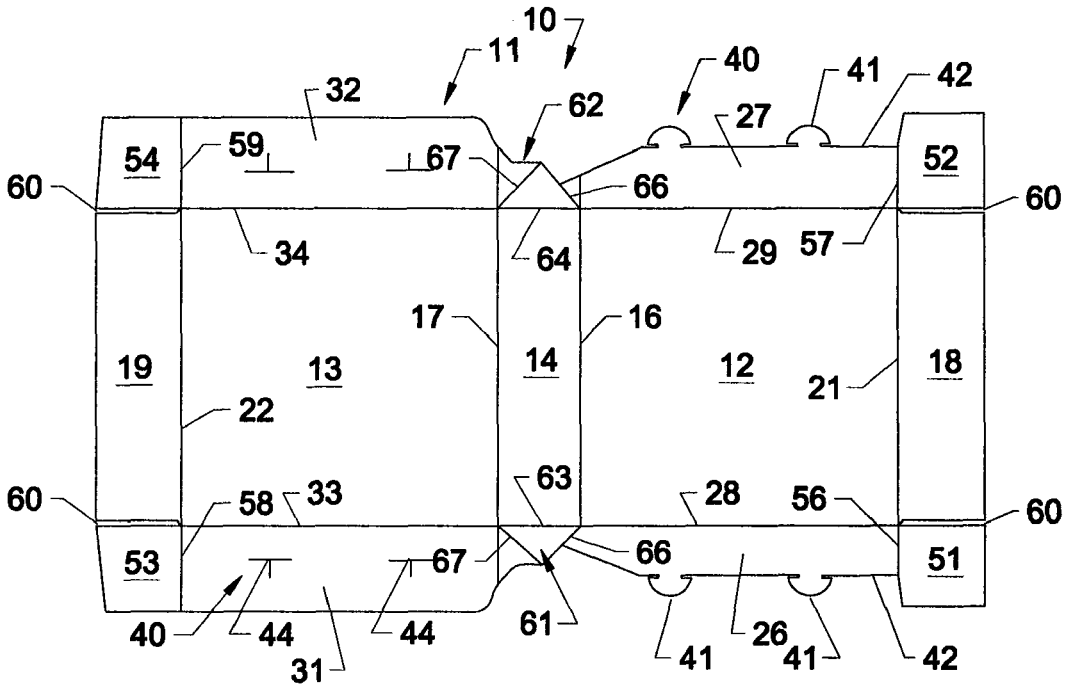
FIGS. 2A-2C are plan views of various alternative embodiments of the flat blank carton of FIG. 1.
Figure 2B:
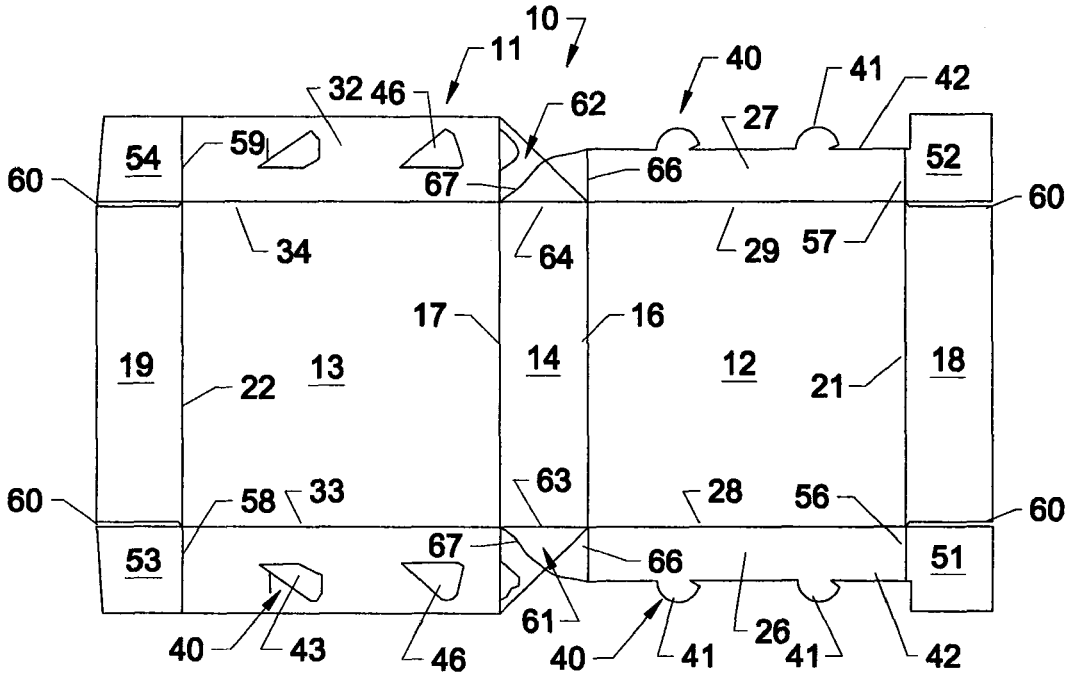
Figure 2C:
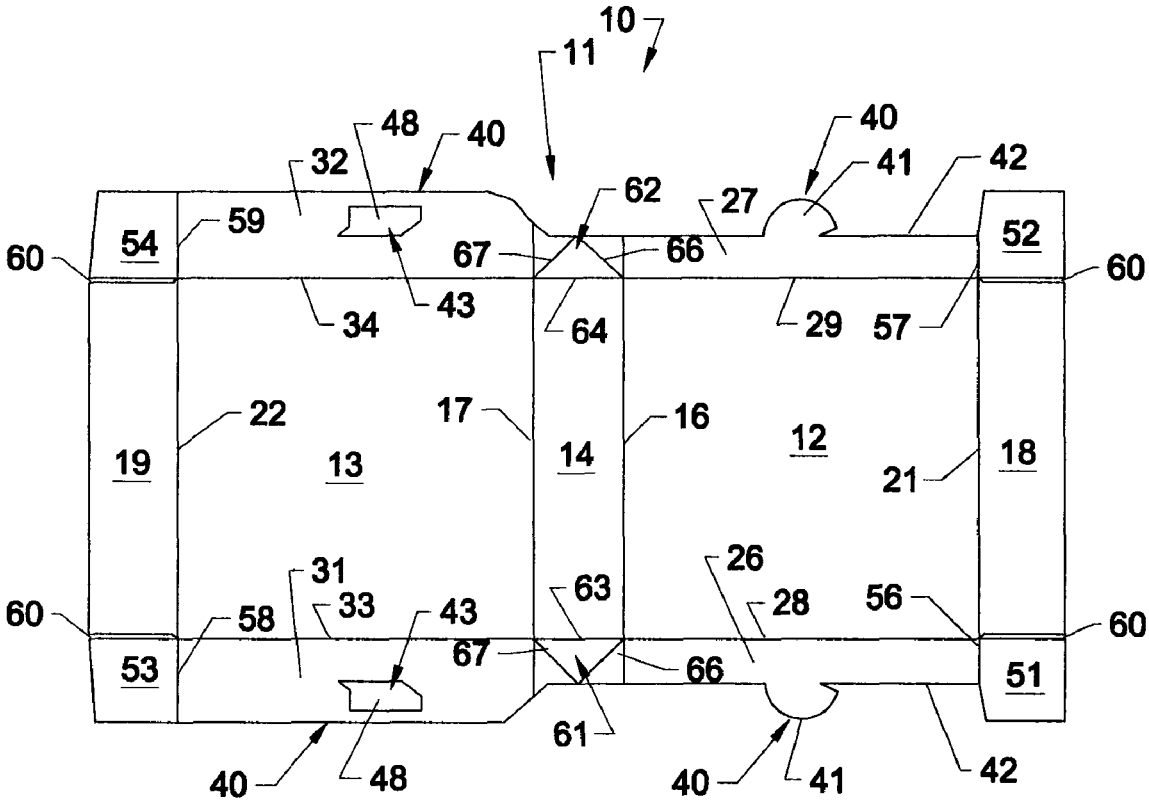

As generally indicated in FIGS. 1-2C, the flat blank carton 10 of the present invention generally will be stamped, die cut, or otherwise formed into a flat blank 11 from one or more sheets of a carton material such as paperboard, cardboard, or various other paper or plastic materials. The carton 10 can be stamped or cut from a single sheet of material, or can be formed from a series of layers of carton materials that have been laminated together to form the carton blank 11. The flat blanks 11 can further be stacked as substantially flat sheets as they are stamped, die-cut, or otherwise formed, for transport as flat stacked sheets arranged on pallets to optimize space for storage and transport.

The flat blank carton 10 (FIGS. 2A-2C) generally will include a top panel 12, a bottom or base panel 13, and a rear panel 14, that define the upper, lower, and rear surfaces or portions of the carton 10. The rear panel 14 is hingedly attached to the top panel 12 by a first laterally extending fold line 16, and to the base panel 13 by a second laterally extending fold line 17. Each of the fold lines 16 and 17 can be formed by scoring, creasing, cutting, or otherwise weakening the area between the top, base, and rear panels to facilitate folding of the top panel and base panel with respect to the rear panel. Upper and lower front flaps 18 and 19 further are hingedly attached to the top and base panels 12 and 13, respectively, along third and fourth laterally extending fold lines 21 and 22, as indicated in FIGS. 2A-2C. The fold lines 21 and 22 can be formed by scoring, cutting, creasing, or otherwise weakening the area between the top and base panels and their respective upper and lower front flaps 18 and 19 to facilitate folding of the front flaps toward their top and base panels, respectively, as the carton blank 11 is folded into an enclosed carton 10, such as indicated in FIG. 1. In their folded and closed configuration, the upper and lower front flaps generally will be oriented parallel to the rear panel 14 to form the enclosed carton 10.

A pair of opposed upper, first, and second side flaps 26 and 27 are hingedly attached to the lateral side edges of the top panel 12 along first and second longitudinally extending fold lines 28 and 29, respectively. Similarly, a pair of opposed lower or third and fourth side flaps 31 and 32 are hingedly attached to the lateral side edges of the base panel 13 along third and fourth longitudinally extending fold lines 33 and 34, respectively. In similar fashion to the laterally extending fold lines 16, 17, 21, and 22, the longitudinally extending fold lines 28, 29, 33 and 34 can be formed in the carton blank 11 by stamping, cutting, creasing, or otherwise forming weakened areas in the carton blank between the upper and lower side flaps and the their respective top and base panels. The fold lines enable the upper and lower side flaps 26, 27 and 31, 32 to be folded inwardly into a vertically oriented configuration, with the upper side flaps generally being received and locked or otherwise engaged in a folded position adjacent the lower side flaps as the carton 10 is formed, as illustrated in FIGS. 1, 3, and 4 to form the sides of the carton.

Figure 3:
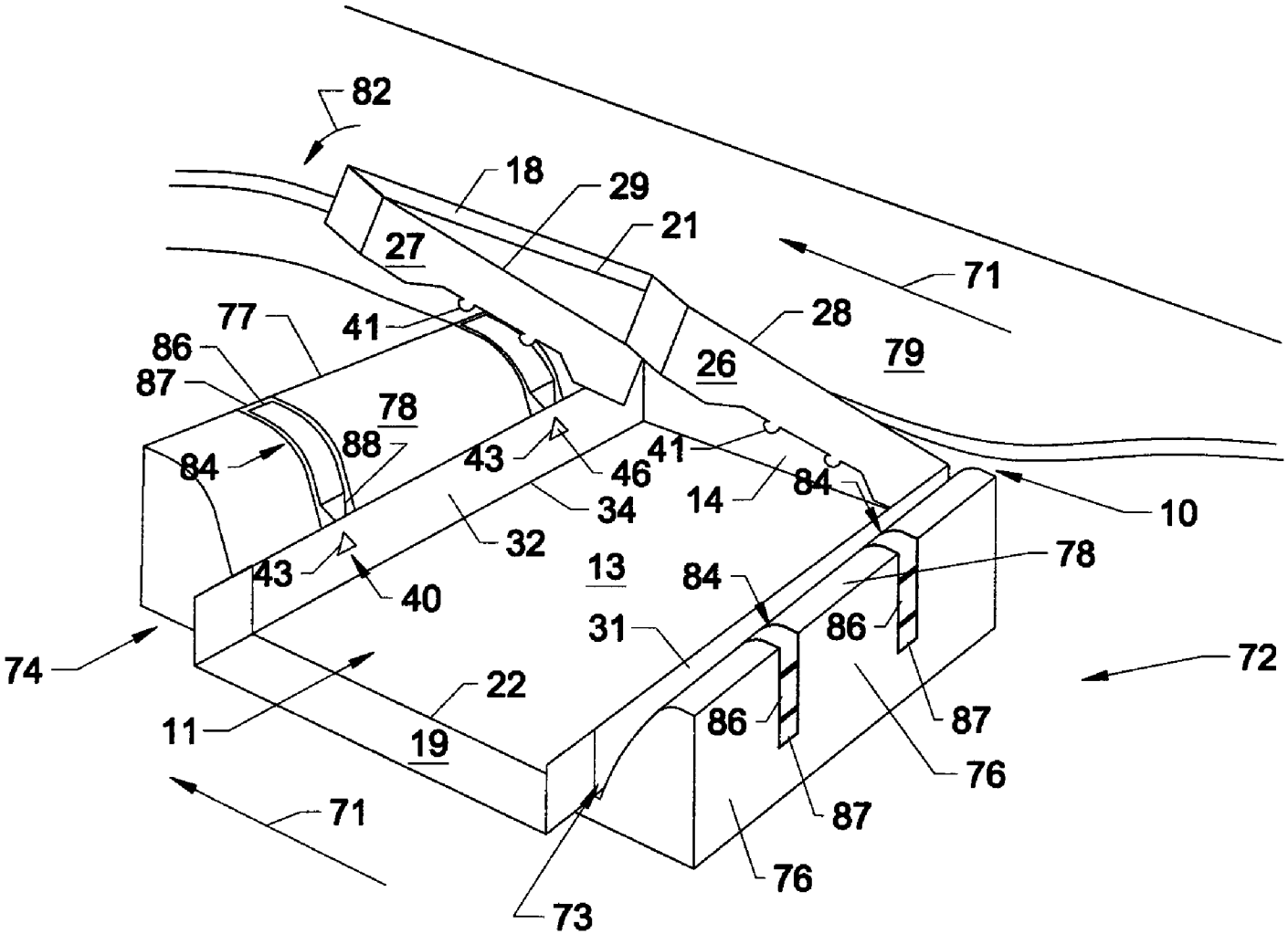
FIG. 3 is a perspective illustration of the flat blank carton of the present invention being folded over into a closed configuration.
Figure 4:
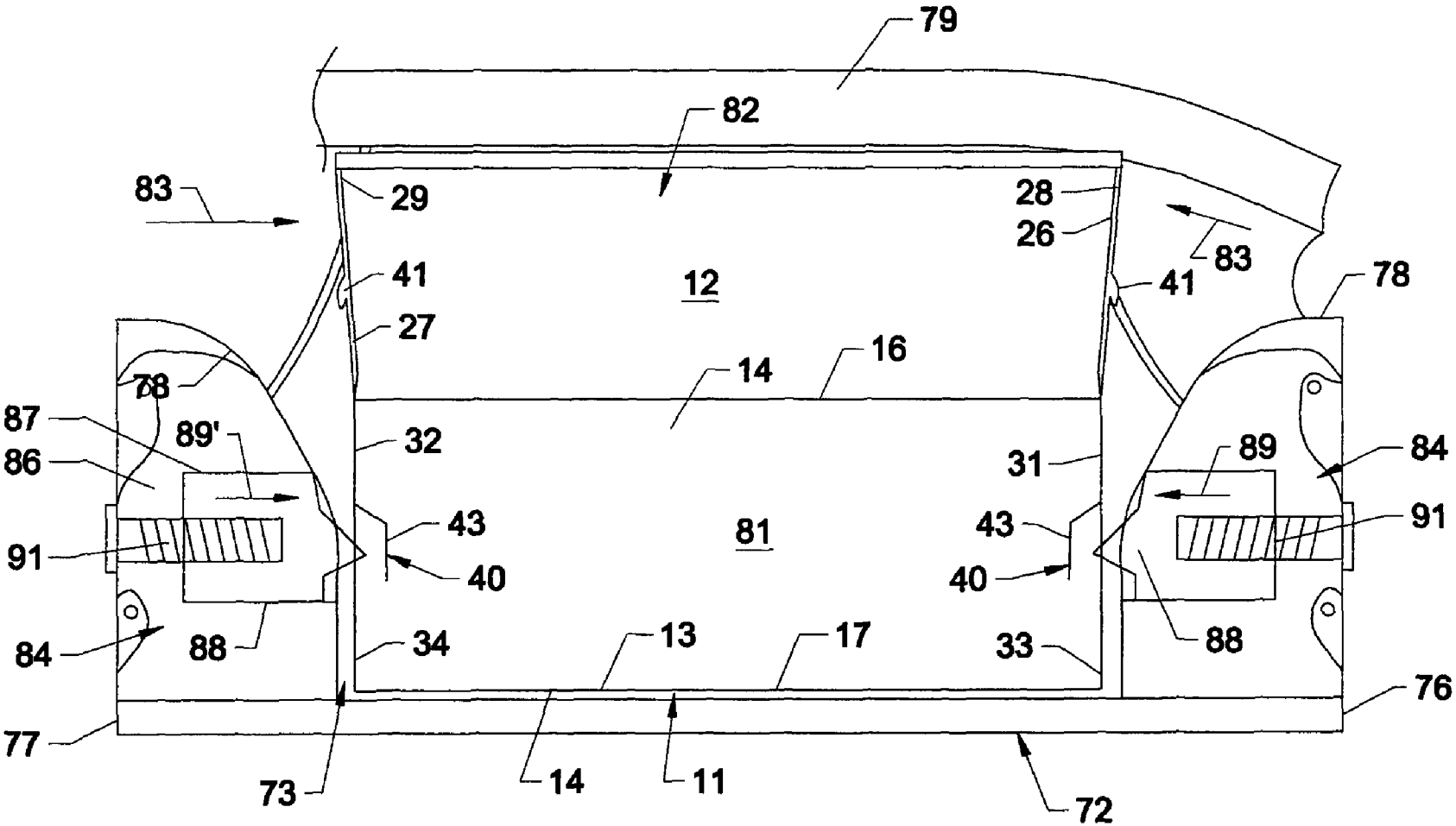
FIG. 4 is an end view taken in partial cross-section, illustrating the engagement of the locking lugs with the side flaps of the flat blank carton of the present invention.

As indicated in FIGS. 2A-3, one or more locking mechanisms 40, 41 generally will be formed along at least one pair of opposed upper and lower side flaps 26, 27, 31, and 32, respectively. As indicated in FIGS. 2A-2C, the locking mechanisms generally can include one or more locking tabs or protrusions 41 generally formed in or along peripheral side edge 42 of one or both the upper and lower side flaps of the carton blank. For purposes of illustration, the protrusions 41 are shown as being formed along the side edges of the upper side flaps in FIGS. 2A-2C, although they could also be formed at other points along the upper and lower side flaps. Locking tabs or protrusions 41 further can formed in varying configurations, including rounded, hook-shaped configurations such as shown in FIGS. 2C and 2B, or substantially T-shaped, with hooked portions at either edge, such as generally indicated in FIG. 2A. Still further, the number of locking protrusions or tab can be varied, depending on the size and configuration of the carton 10 being formed. Thus, it will be understood that while two to four locking tabs formed along the side edges of each of the upper side flaps are illustrated in the example embodiments of FIGS. 2A-2C, various other configurations including a lesser or greater number of locking tabs also can be used.

Figure 5A:
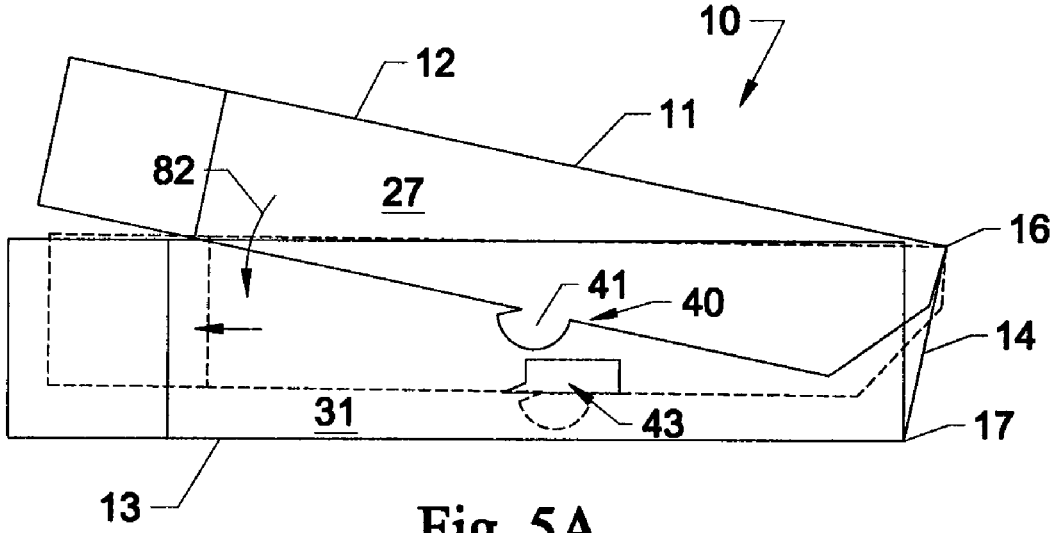
FIG. 5A is a side view illustrating the folding and closing of the carton of the present invention.
Figure 5B:
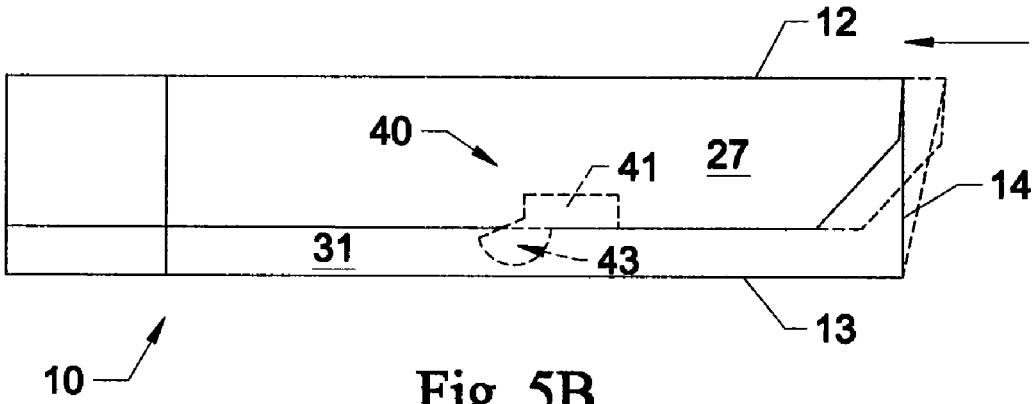
FIG. 5B is a side view illustrating the engagement of the locking tabs with the locking recesses of the flat blank carton of the present invention .
Figure 5C:
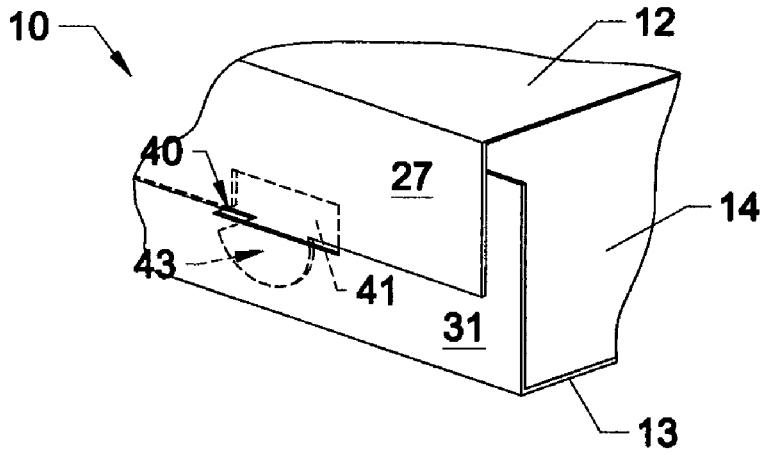
FIG. 5C is a cut-away view of a locking tab engaging its mating locking recess as illustrated in FIG. 5B.

Still further, a series of locking apertures or recesses 43 can be formed in the lower side flaps 31 and 32 for receiving the locking tabs 41 of the upper side flaps 26 and 27 in mating, locking engagement therewith. There generally will be a locking recess or aperture 43 for each of the locking tabs 41, with the locking recesses generally being formed with a design or configuration optimized to readily or easily receive its locking tab in mating engagement therewith. The locking recesses can include L- or T-shaped slits or cuts as shown at 44 in FIG. 2A; can be formed from cut-outs as shown at 43 in FIGS. 2B and 2C; that can have a pie wedge or substantially triangular shape as shown at 46 in FIG. 2B; can be substantially square or rectangular shaped as shown at 48 in FIG. 2C; or can be another shape adapted to engage with the locking tabs. The engagement of the locking tabs with their mating locking recesses (as generally illustrated in FIGS. 5A-5C) further can provide a substantially tamper-evident and/or tamper-proof lock or connection such that attempts to open the carton by disengaging the locking tabs and recesses will damage the tabs and/or recesses. Such damage can provide a visual indicator of tampering with the carton and/or its contents.

As further illustrated in FIGS. 1-2C, one or more pairs of end flaps, as shown at 51 and 52 and 53 and 54, are attached to distal ends of the upper side flaps 26 and 27 and lower side flaps 31 and 32 by a series of laterally extending fold lines 56-59. The end flaps 51-54 further typically are separated from the upper and lower front flaps by a slit, cut, or other line of separation 60 to enable the end flaps to be folded inwardly toward the center of the carton 10, as indicated in FIG. 1, to enable the upper and lower front flaps to be folded over for closing and sealing the carton.

In addition, gussets 61 and 62 can be formed between the upper and lower side flaps along the outer side edges 63 and 64 of the rear panel 14. As indicated in FIGS. 2A-2C, the gussets can be created by forming stamping, cutting, pressing or creasing nicks, cuts, creases, or otherwise forming foldable portions as so as to define and form fold lines, indicated by lines 66 and 67 within the gusset panels 61 and 62 adjacent the rear panel 14 to enable the gussets to be folded against the rear panel and sides of the carton as the carton is formed. Additionally, depending on the size of the cartons, cutout portions 68 (FIG. 2B) also can be formed to facilitate the folding and/or closing of the gussets inwardly as the rear panel is folded upwardly toward the base panel during folding and formation of the carton blank 11 into the carton 10, as indicated in FIG. 1.

FIGS. 1, 3, and 4-5C, generally illustrate the folding of the rear and top panels and side flaps of the carton blank 11 to form a resultant carton 10 in which products P are received and sealed for transportation and storage. The carton blanks 11 generally will be moved along a path of travel, indicated by arrow 71 in FIG. 1, along a product packaging line 72 or though a packaging machine, in which the panels of the carton blank 11 will be folded to form the carton blank into a carton 10. After which, the products P will be inserted into the carton and the carton sealed and removed from the product packaging line. As indicated in FIGS. 1 and 3, at the start of a packaging operation, the base panel 13 of the carton blank 11 generally will be placed within a jig or flight 73 of a flighted carton conveyor 74 for conveying the carton blanks along their path 71. Each flight 73 of the carton conveyor 74 generally will be bordered at its upstream and downstream edges by upstanding walls or lugs 76 and 77, with the base panel being received in a substantially flat-lying attitude between the front and rear walls or lugs 76 and 77. As indicated in FIGS. 1, 3, and 4, the lugs or walls 76 and 77 can have inwardly curving sloped sides 78 that tend to guide the side flaps of the blank inwardly so as to be folded into a substantially vertically oriented attitude.

As the carton blank 11 begins its movement along its path of travel 71 along the product packing line 72, the top panel of the carton blank generally can be engaged by a guide or plow 79 (FIG. 1), or other turning and/or guiding mechanisms, which causes the top panel 12 to be urged upwardly and folded over toward the base panel 13. At substantially the same time, the upper side flaps generally are folded or directed inwardly and downwardly, while the rear panel likewise is folded upwardly into a substantially vertically oriented attitude. The gussets 61 and 62 in FIGS. 2A-2C, or rear panel end flaps of the carton blank, additionally will be directed inwardly toward the rear panel and the upstanding lower side flaps 31 and 32, as the rear panel is folded upwardly and forwardly. As the rear panel is oriented vertically, the gussets or rear panel end flaps generally tend to engage the lower side flaps to halt further forward movement of the rear panel as the top panel is folded further forwardly along fold line 16 between the rear panel and top panel.

As indicated in FIGS. 1, 4, and 5A as the top panel is folded forwardly into a position overlying and spaced from the base panel, the upper side flaps 26 and 27 are guided inwardly so as to be folded along fold lines 28 and 29, toward the center portion 81 of the carton 10. As the top panel is urged downwardly in the direction of arrow 82, its upper side flaps 26 and 27 are urged or guided inwardly by the sloping sides 78 of the walls 76 of each jig or flight 73 in the direction of arrows 83 (FIG. 4). Thereafter, as the upper side flaps slide along the sides of the walls 76 of the flight or jig, into a position extending substantially parallel to the folded lower side flaps 31 and 32, the locking projections or tabs 41 formed in the upper side flaps will be engaged by locking lugs or actuators 84 as indicated in FIG. 4. The locking lugs or actuators 84 each generally will include a body 86 having a similar sloped or angled construction or configuration to that of the lugs or walls 76 and 77 of each flight 73 and can be received within slots 87 formed in the walls 76 and 77 as indicated in FIGS. 3, and 5B-5C.

A tongue or pusher element 88 (FIG. 3) is mounted within the body 76 of each locking lug. The tongues of the locking members will tend to engage and urge the locking tabs or projections in the direction of arrows 89 and 89' inwardly as the locking tabs are passed thereover, and further can engage the locking recesses or slits to help retain the carton in its flight. This engagement tends to press or urge the locking tabs 41 generally into and through their corresponding locking recesses or apertures 43, as indicated in FIGS. 1, 4 and 5B-5C, and into locking engagement with the locking recesses or apertures to lock and secure the upper and lower side flaps together and thus define an open ended carton 10. The locking lugs 84 (FIG. 4) further can be formed in a variety of sizes, although it could be possible to provide substantially standard sizes for the locking lugs, i.e., small, medium, and large size locking lugs, each of which can accommodate a variety of different size or configurations or cartons. The locking lugs also can be removeably fitted and locked within the slots or recesses 87 when formed in the walls of each flight to enable quick and easy replacement of the locking lugs as needed, without requiring change out of the lugs or walls of the conveyor flights to accommodate different size cartons.

As indicated in FIG. 1, with the side flaps locked in place, the now-formed, open-ended carton is moved further forwardly along its path of travel 71 to a loading station indicated by 95 in which products P (here shown as frozen pizzas, although other various types of products can be used) can be loaded into the open end 96 of the carton 10. Thereafter, the carton will be moved through folder/gluer stations, generally indicated at 97 and 98, in which the end flaps of the cartons generally will be folded inwardly. An adhesive material can be applied to one or both of the upper and lower front flaps, which are then folded into engaging, adhesive contact to seal the cartons with the products contained therein. Thereafter, transfer belts 99 can engage the completed, enclosed cartons 10 and convey them away for transportation or storage.

Such a method of forming, packing, and sealing the flat blank cartons of the present invention generally can be performed as part of a substantially continuous packaging operation as indicated in FIG. 1. However, it is also possible to form, pack, and seal the flat blank carton of the present invention using an intermittent motion or packaging operation. In such an intermittent packaging operation, the flat blanks can be fed from a magazine or supply into engagement with a forming tool or die whereupon the blank can be engaged with a reciprocating plunger or similar tool that engages and urges the blank into the forming tool. As the blank engages and/or passes through the forming tool, the panels of the blank are caused to be folded along their longitudinal and laterally extending fold lines so that the blank is formed into an open ended carton. Thereafter, the carton can be removed from the forming tool, loaded with product, and sealed.

Accordingly, the present invention comprises a flat blank carton that can be formed, shipped and stored as a substantially single sheet of a carton material, which thereafter can be folded into a carton with the sides of the carton being locked together as the carton is moved along a product packaging line to enable the rapid packaging of products as an alternative to the use of pre-glued, pre-formed carton sleeves.

It will be understood by those skilled in the art that while the present invention has been discussed above with reference to particular embodiments, various modifications, additions and changes can be made to the present invention without departing from the spirit and scope of the present invention.

What is claimed:

1. A method of packaging products comprising:

moving a series of carton blanks along a path of travel, each of the carton blanks comprising a substantially flat sheet of a carton material having top and base panels connected by a rear panel, first, second, third, and fourth side flaps respectively hingedly connected to the top and base panels and respectively including cooperating locking elements formed therein, the locking elements including a locking projection and a corresponding locking receptacle, and upper and lower front flaps respectively hingedly attached to the top and base panels;

for each carton blank, engaging and urging the top panel toward the base panel;

as the top panel of each carton blank is moved downwardly toward the base panel, guiding the first and second side flaps of each carton blank toward the third and fourth side flaps;

engaging the locking projection along at least one of the first and second side flaps of each carton blank with a locking lug and urging the locking projection into the corresponding locking receptacle formed in a corresponding one of the third and fourth side flaps to lock the side flaps together and form a carton having an open end;

loading products into the open end of each carton; and closing the upper and lower front flaps of each carton.

2. The method of claim 1 and wherein the engaging and urging the top panel toward the base panel comprises moving the top panel into engagement with a guide, and guiding the top panel upwardly and forwardly so as to be folded over the base panel.

3. The method of claim 1 and wherein the engaging the locking projection along the at least one of the first and second side flaps with the locking lug and urging the locking projection into the corresponding locking receptacle comprises folding at least one of the side flaps downwardly and inwardly toward the base panel, and as the at least one of the side flaps passes the locking lug, urging the locking projection inwardly into and through the corresponding locking receptacle.

4. The method of claim 1 and wherein the closing the upper and lower front flaps comprises applying an adhesive to at least one of the upper and lower front flaps and folding the upper and lower front flaps into engagement.

5. The method of claim 1 and wherein the engagement of each locking projection with the corresponding locking receptacle forms a substantially tamper evident lock along at least one of the first and second side flaps.

6. The carton of claim 5 and wherein the substantially tamper-evident lock is for providing a visual indication of tampering with the carton.

7. The carton of claim 6 and wherein the visual indication of tampering comprises damage to at least one of the locking projection and a locking edge of the corresponding locking receptacle upon disengagement of the locking projection from the locking edge.

8. The method of claim 1 wherein the moving the series of carton blanks along the path of travel comprises moving the series of carton blanks along a packaging line.

9. The method of claim 8 wherein each blank is received in a flight of a carton conveyor of the packaging line, the flight having an upstream wall and a downstream wall, wherein the locking lug is operatively connected to one of the upstream wall and the downstream wall.

10. The method of claim 9 wherein the locking lug comprises a pusher element, and the engaging the locking projection comprises extending the pusher element inward from an exterior surface of the one of the upstream wall and the downstream wall and contacting the locking projection with the pusher element.

11. The method of claim 1 and wherein the method comprises, for each carton blank, moving the rear panel upwardly and directing gussets of the carton blank toward the rear panel to halt further forward movement of the rear panel as the top panel is moved toward the base panel.

12. The method of claim 1 and wherein the locking projection being within the corresponding locking receptacle forms a substantially tamper-evident lock such that disengaging the locking receptacle and the corresponding locking projection from one another would damage at least one of the locking receptacle and the corresponding locking projection, thereby providing a visual indicator of tampering.

13. The method of claim 1 and wherein the urging the top panel toward the base panel comprises moving the top panel into engagement with a guide, and guiding the top panel upwardly and forwardly so as to be folded over the base panel.

14. The method of claim 1 and wherein for each carton blank:

the base panel has front, rear, and side edges;

the top panel has front, rear, and side edges;

the rear panel extends between the rear edges of the base and top panels;

the upper and lower front flaps are attached to the front edges of the base and top panels, respectively;

the first and second side flaps are upper side flaps respectively extending along the side edges of the top panel, and the locking projection along at least one of the first and second side flaps comprises each of the upper side flaps having at least one locking projection arranging along a free edge thereof; and the third and fourth side flaps are lower side flaps respectively extending along the side edges of the base panel, and the corresponding locking receptacle comprises each of the lower side flaps having at least one locking receptacle therealong and adapted to receive a corresponding one of the at least one locking projection of a corresponding upper side flap to lock the upper side flaps into the lower side flaps as the top panel is folded over the base panel.

15. A method of packaging products comprising:

moving a series of carton blanks along a path of travel, each of the carton blanks comprising a substantially flat sheet of a carton material having top and base panels connected by a rear panel, first, second, third, and fourth side flaps respectively hingedly connected to the top and base panels and respectively including cooperating locking elements formed therein, the locking elements including a locking projection and a corresponding locking receptacle, and upper and lower front flaps respectively hingedly attached to the top and base panels;

for each carton blank, engaging and urging the top panel toward the base panel;

as the top panel of each carton blank is moved downwardly toward the base panel, guiding the first and second side flaps of each carton blank toward the third and fourth side flaps;

engaging the locking projection along at least one of the first and second side flaps of each carton blank with a locking lug and urging the locking projection into the corresponding locking receptacle formed in a corresponding one of the third and fourth side flaps to lock the side flaps together and form a carton having an open end positioned opposite to the rear panel;

loading products into the open end of each carton; and closing the upper and lower front flaps of each carton.

16. The method of claim 15 and wherein the engaging and urging the top panel toward the base panel comprises moving the top panel into engagement with a guide, and guiding the top panel upwardly and forwardly so as to be folded over the base panel.

17. The method of claim 15 and wherein the engaging the locking projection along the at least one of the first and second side flaps with the locking lug and urging the locking projection into the corresponding locking receptacle comprises folding at least one of the side flaps downwardly and inwardly toward the base panel, and as the at least one of the side flaps passes the locking lug, urging the locking projection inwardly into and through the corresponding locking receptacle.

18. The method of claim 15 wherein the moving the series of carton blanks along the path of travel comprises moving the series of carton blanks along a packaging line, and wherein each blank is received in a flight of a carton conveyor of the packaging line, the flight having an upstream wall and a downstream wall, wherein the locking lug is operatively connected to one of the upstream wall and the downstream wall.

19. The method of claim 18 and wherein the locking lug comprises a pusher element, and the engaging the locking projection comprises extending the pusher element inward from an exterior surface of the one of the upstream wall and the downstream wall and contacting the locking projection with the pusher element.

20. The method of claim 15 and wherein the method comprises, for each carton blank, moving the rear panel upwardly and directing gussets of the carton blank toward the rear panel to halt further forward movement of the rear panel as the top panel is moved toward the base panel.

21. The method of claim 15 and wherein the locking projection being within the corresponding locking receptacle forms a substantially tamper-evident lock such that disengaging the locking receptacle and the corresponding locking projection from one another would damage at least one of the locking receptacle and the corresponding locking projection, thereby providing a visual indicator of tampering.

22. The method of claim 15 and wherein the urging the top panel toward the base panel comprises moving the top panel into engagement with a guide, and guiding the top panel upwardly and forwardly so as to be folded over the base panel.

23. The method of claim 15 and wherein for each carton blank:

the base panel has front, rear, and side edges;

the top panel has front, rear, and side edges;

the rear panel extends between the rear edges of the base and top panels;

the upper and lower front flaps are attached to the front edges of the base and top panels, respectively;

the first and second side flaps are upper side flaps respectively extending along the side edges of the top panel, and the locking projection along at least one of the first and second side flaps comprises each of the upper side flaps having at least one locking projection arranging along a free edge thereof; and the third and fourth side flaps are lower side flaps respectively extending along the side edges of the base panel, and the corresponding locking receptacle comprises each of the lower side flaps having at least one locking receptacle therealong and adapted to receive a corresponding one of the at least one locking projection of a corresponding upper side flap to lock the upper side flaps into the lower side flaps as the top panel is folded over the base panel.

* * * * *